US011176920B2

(12) United States Patent
Kim

(10) Patent No.: US 11,176,920 B2
(45) Date of Patent: Nov. 16, 2021

(54) APPARATUS FOR COLLECTING SOUNDS IN WIDE AREA WITHOUT LOSS OF SOUNDS, AND USE METHOD THEREFOR

(71) Applicant: Geum Cheol Kim, Incheon (KR)

(72) Inventor: Geum Cheol Kim, Incheon (KR)

(73) Assignee: Geum Cheol Kim, Gyeonggi-do (KR)

( * ) Notice: Subject to any disclaimer, the term of this patent is extended or adjusted under 35 U.S.C. 154(b) by 122 days.

(21) Appl. No.: 16/603,178

(22) PCT Filed: Apr. 6, 2018

(86) PCT No.: PCT/KR2018/004101
§ 371 (c)(1),
(2) Date: Oct. 4, 2019

(87) PCT Pub. No.: WO2018/186716
PCT Pub. Date: Oct. 11, 2018

(65) Prior Publication Data

US 2021/0110805 A1 Apr. 15, 2021

(30) Foreign Application Priority Data

Apr. 6, 2017 (KR) ..... 10-2017-0044944

(51) Int. Cl.
*G10K 11/08* (2006.01)
*G10L 21/0216* (2013.01)
*G10L 21/0316* (2013.01)

(52) U.S. Cl.
CPC ..... *G10K 11/08* (2013.01); *G10L 21/0216* (2013.01); *G10L 21/0316* (2013.01)

(58) Field of Classification Search
None
See application file for complete search history.

(56) References Cited

U.S. PATENT DOCUMENTS

| | | | | |
|---|---|---|---|---|
| 5,696,356 | A | 12/1997 | Dudley et al. | |
| 7,577,262 | B2 | 8/2009 | Kanamori et al. | |
| 2003/0050039 | A1* | 3/2003 | Baba | H04M 1/72424 455/404.1 |
| 2007/0116296 | A1* | 5/2007 | Hsieh | H03G 3/32 381/72 |
| 2011/0022403 | A1* | 1/2011 | Washisu | H04N 5/60 704/503 |

(Continued)

FOREIGN PATENT DOCUMENTS

| | | | |
|---|---|---|---|
| JP | 01-044613 | A | 2/1989 |
| JP | 07-168586 | A | 7/1995 |

(Continued)

OTHER PUBLICATIONS

JP07-306694, Tsukada, Nov. 21, 1995, English Translation. (Year: 1995).*

*Primary Examiner* — Paul W Huber
(74) *Attorney, Agent, or Firm* — Brundidge & Stanger, P.C.

(57) ABSTRACT

The present invention relates to a system and a method for collecting unspecific and various sounds, occurring in the field of crime prevention, guard, or the like, in a wide area by means of a microphone without any loss, and provides means for a system and a method for collection using a single microphone and for a system and a method for collection using multiple microphones.

6 Claims, 7 Drawing Sheets

(56) References Cited

U.S. PATENT DOCUMENTS

2016/0352300 A1* 12/2016 Nozokido ..... H03F 3/183

FOREIGN PATENT DOCUMENTS

| | | | |
|---|---|---|---|
| JP | 07-306694 | A | 11/1995 |
| JP | 2004-187283 | A | 7/2004 |
| KR | 10-0138369 | B1 | 5/1998 |
| KR | 20-2010-0003992 | U | 4/2010 |
| KR | 10-1384781 | B1 | 4/2014 |
| KR | 10-1519430 | B1 | 5/2015 |
| KR | 10-1547729 | B1 | 8/2015 |

* cited by examiner

APPARATUS FOR COLLECTING SOUNDS IN WIDE AREA WITHOUT LOSS OF SOUNDS, AND USE METHOD THEREFOR

TECHNICAL FIELD

The present invention relates to a system and a method for collection of all sounds generated over a wide area, in particular, unspecified, unpredictable and uncontrolled sounds having different characteristics in fields of crime prevention, precaution or guard, etc., using a microphone without loss thereof.

BACKGROUND ART

For detection of sound in fields of crime prevention, security, guard, precaution, etc., the sound cannot be defined or adjusted, occurrence of sound cannot be predicted or controlled, and a sound volume may have a wide range from tiny sound to very loud sound. Further, even the same sound source may have a large difference in loudness modulation (or pitch) and/or such difference may occur for a short period of time, and a plurality of sounds may be mixed. Further, since a situation in an area under observation should be judged using sound having specific features such as being unable to restrict a sound occurrence point, all sounds generated over a wide area need to be collected without transient loss thereof.

Korean Patent Registration No. 10-1384781 discloses an optical fiber sensor as a means to extend a surveillance area by overcoming a spatial limitation of a microphone in collecting sounds while collecting the sounds in fields of crime prevention, precaution, etc. However, the optical sensor may sense a sound pressure but cannot collect sound. Since Korean Patent Registration No. 10-1384181 proposed a sound collection means using the optical sensor instead of a microphone, a means for collecting all sounds generated over a broad area under observation without transient loss thereof is not provided.

Korean Patent Registration No. 10-1519430 discloses an apparatus that selects sound generated in a preset direction among all sounds collected by a microphone, amplifies the sound after removing howls, and directly outputs the same to a speaker. Since a sound selection means in Korean Patent Registration No. 10-1519430 selects specific sound generated in a predetermined direction, all sounds generated over a broad area could not be collected without loss thereof. Further, with regard to a sound amplification means, Korean Patent Registration No. 10-1519430 did not specify a means that amplifies the collected sound at a plurality of amplification factors and then separately stores the amplified sounds in a memory unit, a means to select one among the amplified sounds at a plurality of amplification factors, a means to determine whether or not the amplified sounds are beyond a collection range, etc. Therefore, a means for collecting all sounds generated over a broad area without transient loss thereof is not provided.

Korean Utility Model Laid-Open Publication No. 20-2010-0003992 discloses an apparatus that amplifies sound collected by a microphone installed in the vicinity of a specific sound source set in a memory and then determines whether or not the amplified sound is a target sound in comparison with a level of sound set in the memory. However, since a sound collection means in Korean Utility Model Laid-Open Publication No. 20-2010-0003992 has the microphone located in the vicinity of the specific sound source, the means cannot collect all sounds generated over a broad area without loss thereof. Further, with regard to a sound amplification means, Korean Utility Model Laid-Open Publication No. 20-2010-0003992 did not specify a means that amplifies the collected sound at a plurality of amplification factors and then separately stores the amplified sounds in a memory unit, a means to select one among the amplified sounds at a plurality of amplification factors, a means to determine whether or not the amplified sound is beyond a collection range, etc. Therefore, a means for collecting all sounds generated over a broad area without transient loss thereof is not provided.

Further, Korean Patent Registration No. 10-1547129 and U.S. Pat. No. 5,696,356 were proposed for the purpose of collecting sounds. However, these patents relate to a mechanical device to collect sound in a wide area, which is fundamentally different means from the means proposed in the present invention as an electronic device and does not include any signal processing means.

Accordingly, a system and a method for collection of all sounds generated in fields of crime prevention and precaution over a broad area by a microphone without transient loss thereof are required.

DISCLOSURE

Technical Problem

Accordingly, an object of the present invention is to provide a system and a method for collection of all sounds generated over a broad area, in particular, unspecified, unpredictable and uncontrolled sounds having different characteristics in fields of crime prevention, precaution, etc., using a microphone without transient loss thereof.

Technical Solution

A sound collection system includes devices (microphone, amplification stage, selection unit, memory unit, and control unit) having the following features. A microphone that makes a collected sound from a surrounding sound and transfers a collected sound to an amplification stage; an amplification stage that receives a collected sound from a microphone, amplifies a collected sound at a plurality of amplification factors to make multiple amplified sounds, and transfers multiple amplified sounds to a selection unit; a selection unit that receives multiple amplified sounds from an amplification stage, transfers multiple amplified sounds to a memory unit, selects selected amplification sounds using amplitudes, and transfers control signals including information on selected amplification sounds to a control unit; a memory unit that receives multiple amplified sounds including selected amplification sounds from a selection unit, stores multiple amplified sounds therein, and transfers selected amplification sounds to a control unit in response to requests from a control unit; and a control unit that receives control signals from a selection unit and collects from a memory unit selected amplification sounds corresponding to control signals. A sound collection method includes the following steps. Step a) in which a microphone makes a collected sound from a surrounding sound and transfers collected sound to an amplification stage; step b) in which an amplification stage amplifies collected sound at a plurality of amplification factors to make multiple amplified sounds and transfers multiple amplified sounds to a selection unit; step c) in which a selection unit transfers multiple amplified sounds to a memory unit, selects selected amplification sounds using amplitudes, and transfers control signals including information on selected amplification sounds to a control unit; and a memory unit stores multiple amplified sounds including selected amplification sounds therein; and step d) in which a control unit collects from a memory unit selected amplification sounds corresponding to control signals. Above sound collection system and sound collection method store multiple amplified sounds in a memory unit and collect selected amplification sounds corresponding to control signals. Also, above sound collection system and sound collection method can collect all sounds from over a broad area without loss thereof.

A sound collection system includes devices (first microphone, first amplification stage, first selection unit, second microphone, second amplification stage, second selection unit, memory unit, and control unit) having the following features. A first microphone that makes a first collected sound from a surrounding sound and transfers a first collected sound to a first amplification stage; a second microphone that makes a second collected sound from surrounding sound and transfers a second collected sound to a second amplification stage; a first amplification stage that receives a first collected sound from a first microphone, amplifies a first collected sound at a first plurality of amplification factors to make first multiple amplified sounds, and transfers first multiple amplified sounds to a first selection unit; a second amplification stage that receives a second collected sound from a second microphone, amplifies a second collected sound at a second plurality of amplification factors to make second multiple amplified sounds, and transfers second multiple amplified sounds to a second selection unit; a first selection unit that receives first multiple amplified sounds from a first amplification stage, transfers first multiple amplified sounds to a memory unit, selects first selected amplification sounds using first amplitudes, and transfers first control signals including information on first selected amplification sounds to a control unit; a second selection unit that receives second multiple amplified sounds from a second amplification stage, transfers second multiple amplified sounds to a memory unit, selects second selected amplification sounds using second amplitudes, and transfers second control signals including information on second selected amplification sounds to a control unit; a memory unit that receives first multiple amplified sounds including first selected amplification sounds from a first selection unit, receives second multiple amplified sounds including second selected amplification sounds from a second selection unit, stores first multiple amplified sounds and second multiple amplified sounds therein, and transfers first selected amplification sounds or second selected amplification sounds to a control unit in response to requests from a control unit; and a control unit that receives first control signals from a first selection unit and second control signals from a second selection unit, and collects from a memory unit first selected amplification sounds corresponding to first control signals or second selected amplification sounds corresponding to second control signals. And a sound collection method includes the following steps. Step a) in which a first microphone makes a first collected sound from a surrounding sound and transfers a first collected sound to a first amplification stage; and a second microphone makes a second collected sound from surrounding sound and transfers a second collected sound to a second amplification stage; step b) in which the first amplification stage amplifies a first collected sound at a first plurality of amplification factors to make first multiple amplified sounds and transfers first multiple amplified sounds to a first selection unit; and a second amplification stage amplifies second collected sound at a second plurality of amplification factors to make second multiple amplified sounds and transfers second multiple amplified sounds to a second selection unit; step c) in which a first selection unit transfers first multiple amplified sounds to a memory unit, selects first selected amplification sounds using first amplitudes, and transfers first control signals including information on first selected amplification sounds to a control unit; a second selection unit transfers second multiple amplified sounds to a memory unit, selects second selected amplification sounds using second amplitudes, and transfers second control signals including information on second selected amplification sounds to a control unit; and a memory unit stores first multiple amplified sound including first selected amplification sounds and second multiple amplified sound including second selected amplification sounds therein; and step d) in which a control unit collects from a memory unit first selected amplification sounds corresponding to first control signals or second selected amplification sounds corresponding to second control signals. Above sound collection system and sound collection method store first multiple amplified sounds and second multiple amplified sounds in a memory unit and collect first selected amplification sounds corresponding to first control signals or second selected amplification sounds corresponding to second control signals. Also, above sound collection system and sound collection method can collect all sounds from over a broad area without loss thereof.

A sound collection system includes devices (first microphone, amplification stage, selection unit, second microphone, single amplification unit, ADC unit, memory unit, and control unit) having the following features. A first microphone that makes a first collected sound from a surrounding sound and transfers the first collected sound to an amplification stage; a second microphone that makes a second collected sound from surrounding sound and transfers the second collected sound to a single amplification unit; an amplification stage that receives the first collected sound from the first microphone, amplifies first collected sound at a plurality of amplification factors to make multiple amplified sounds, and transfers multiple amplified sounds to a selection unit; a single amplification unit that receives second collected sound from a second microphone, amplifies second collected sound at a single amplification factor to make a single amplified sound, and transfers single amplified sound to a ADC unit; a selection unit that receives multiple amplified sounds from an amplification stage, transfers multiple amplified sounds to a memory unit, selects selected amplification sounds using amplitudes, and transfers control signals including information on selected amplification sounds to a control unit; an ADC unit that receives single amplified sound from a single amplification unit, transfers an ADC amplified sound corresponding to a single amplified sound to a memory unit, and transfers an ADC control signal including information on an ADC amplified sound to a control unit; a memory unit that receives multiple amplified sounds including selected amplification sounds from a selection unit, receives an ADC amplified sound from an ADC unit, stores multiple amplified sounds and an ADC amplified sound therein, and transfers selected amplification sounds or an ADC amplified sound to a control unit in response to requests of a control unit; and a control unit that receives control signals from a selection unit and an ADC control signal from an ADC unit, and collects from a memory unit selected amplification sounds corresponding to control signals or an ADC amplified sound corresponding to an ADC control signal. And a sound collection method includes the following steps. Step a) in which a first microphone makes a first collected sound from a surrounding sound and transfers the first collected sound to an amplification stage; and a second microphone makes a second collected sound from surrounding sound and transfers a second collected sound to a single amplification unit; step b) in which an amplification stage amplifies a first collected sound at a plurality of amplification factors to make multiple amplified sounds and transfers multiple amplified sounds to a selection unit; and a single amplification unit amplifies a second collected sound at a single amplification factor to make a single amplified sound and transfers a single amplified sound to a ADC unit; step c) in which a selection unit transfers multiple amplified sounds to a memory unit, selects selected amplification sounds using amplitudes, and transfers control signals including information on selected amplification sounds to a control unit; an ADC unit transfers an ADC amplified sound corresponding to a single amplified sound to a memory unit and transfers an ADC control signal including information on an ADC amplified sound to a control unit; and a memory unit stores multiple amplified sound including selected amplification sounds and an ADC amplified sound therein; and step d) in which a control unit collects from a memory unit selected amplification sounds corresponding to control signals or an ADC amplified sound corresponding to an ADC control signal. Above sound collection system and sound collection method store multiple amplified sounds and an ADC amplified sound in a memory unit and collect selected amplification sounds corresponding to control signals or ADC amplified sound corresponding to an ADC control signal. Also, above sound collection system and sound collection method can collect all sounds from over a broad area without loss thereof.

Advantageous Effects

Using only a microphone may collect all sounds generated over a broad area, in particular, unspecific, unpredictable and uncontrolled sounds having different characteristics, without loss thereof.

PREFERRED EMBODIMENT OF INVENTION

Figure 1:
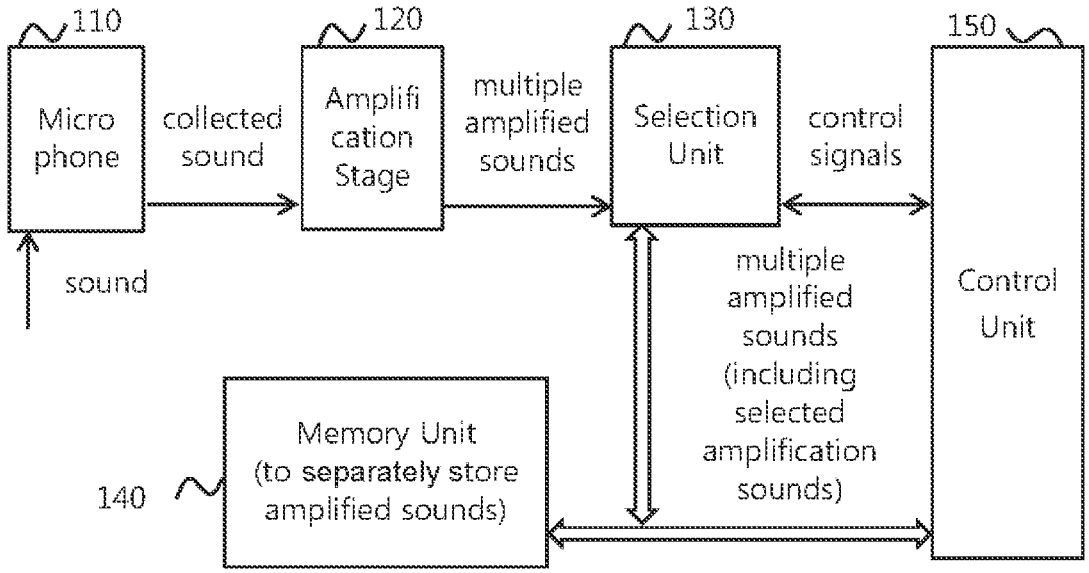
FIG. 1 is a configuration diagram illustrating a system for collection of sound by a single microphone according to one embodiment of the present invention.

Hereinafter, preferred embodiments of the present invention will be described in detail with reference to the accompanying drawings. Herein, terms used in the specification and appended claims are not restrictedly interpreted as typical or dictionary meanings but to have meanings and concepts consistent with technical details of the present invention.

Configurations described in the embodiments of the present specification and illustrated in the drawings are proposed only as preferred embodiments of the present invention and do not represent all of technical features of the present invention. Therefore, various equivalents and modifications of the present invention are possible at a point of time when the present application has been filed.

Figure 4:
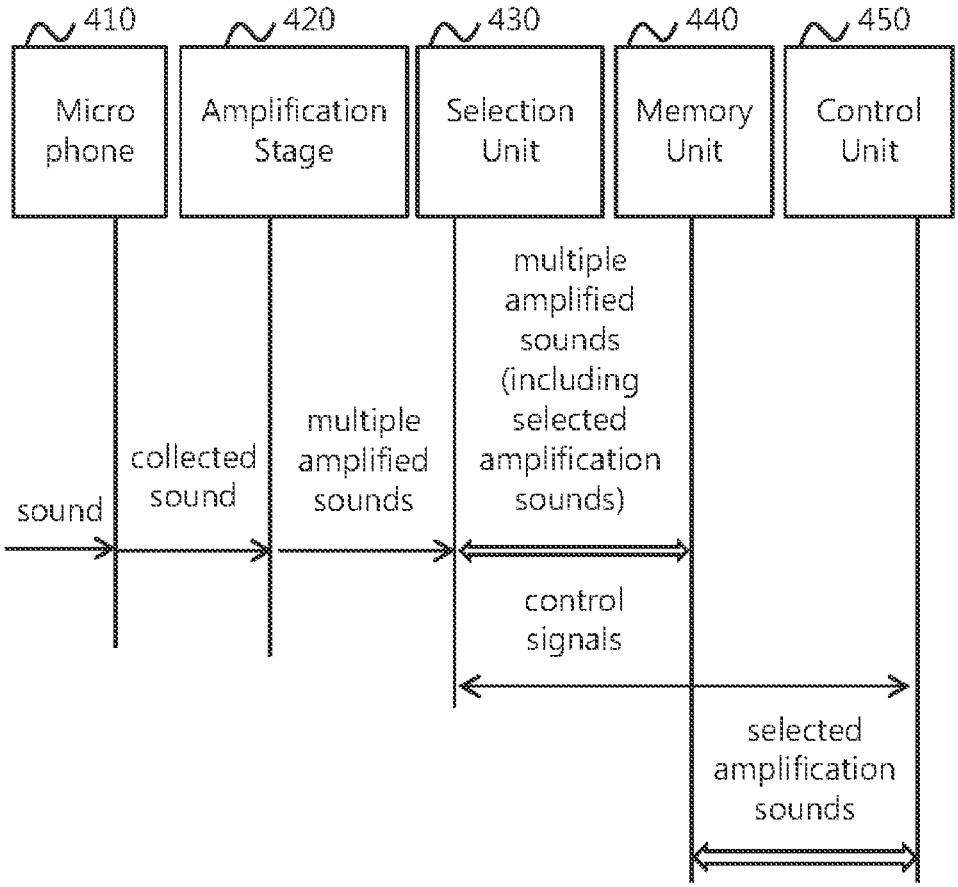
FIG. 4 is a flowchart of FIG. 1 according to the embodiment of the present invention.

FIG. 1 is a configuration diagram of a system for collecting all sounds generated over a broad area using a single microphone without loss hereof, while FIG. 4 is a flowchart of FIG. 1.

Referring to FIGS. 1 and 4, the present invention provides a system and a method for collection of sound, characterized in that: a microphone 110 may collect all sounds generated over a broad area and transfer the collected sound to an amplification stage 120; the amplification stage 120 may amplify the collected sound at a plurality of amplification factors and transfer the multiple amplified sounds to a selection unit 130; the selection unit 130 may communicate with a control unit via control signals in order to separately store the multiple amplified sounds in a memory unit 140, while determining an amplitude of each amplified sound, adding information on the selected amplified sounds to the control signals, and transmitting the control signals to a control unit 150; and the control unit 150 may search the memory unit 140 for the selected amplification sounds corresponding to the control signals and control the same, thereby collecting all sounds generated over a broad area without loss thereof.

The microphone is a device to collect sound from the surroundings and to convert the same into an electrical signal.

The sound to be collected herein may include sound occurring in a situation such as crime prevention, precaution, etc. Such sound has undefined and non-adjustable features, as well as unspecified and various characteristics, and occurrence of sound cannot be controlled or regulated. Further, since even transient sound is very significant, all sounds should be collected over an area as broad as possible.

The amplification stage may comprise a plurality of amplifiers having different amplification factors, in order to amplify the sound collected by the microphone at different amplification factors of the amplifiers, respectively, and to transfer the generated multiple sounds, that is, amplified sounds to the selection unit. The amplification stage may include a buffer member to transfer the collected sound to the plurality of amplifiers in the amplification stage and a low pass filter (LPF) or a band pass filter (BPF) to amplify a specific frequency bandwidth only, wherein non-amplification or attenuated amplification may also be included.

The multiple amplified sounds may refer to a bundle of amplified multiple sounds generated by amplifying the collected sound at different amplification factors, respectively, using a plurality of amplifiers having such different amplification factors as described above.

The selection unit may communicate with the control unit via control signals in order to separately store the multiple amplified sounds in the memory unit, while determining the amplitude of each amplified sound and selecting the selected sounds among the multiple amplified sounds. Herein, a time at which the amplified sound occurs may be stored to be determined, or ID of the selected amplified sound and/or time information thereon may be included in the control signals, which in turn is transmitted to the control unit. Further, the selection unit may be provided with LPF member, BPF member and/or an analog to digital conversion (ADC) member so as to continuously determine the multiple amplified sounds and again select the selected sounds among the amplified sounds or store the same in a digital form.

The control signal may include control signals used to store the multiple amplified sounds in the memory unit through communication between the control unit and the selection unit, as well as control signals including ID of the selected amplification sounds and/or time information thereon, wherein the time information is information on a time at which the amplified sound occurs and, when storing the multiple amplification sounds in the memory unit, these sounds may be stored such that a storage position and time information on the amplified sound could be identified. Therefore, even when a different amplified sound is again selected, the control signals may be used to control the amplified sound without loss thereof.

The memory unit may communicate with the selection unit and the control unit in order to separately store the multiple amplification sounds therein, wherein time information is also stored.

The control unit may send control signals to control the selection unit and may search the memory unit for the selected amplification sounds corresponding to the control signals which includes information (ID and/or time information, etc.) on the amplified sound selected by the selection unit and control the selected amplification sounds.

Figure 2:
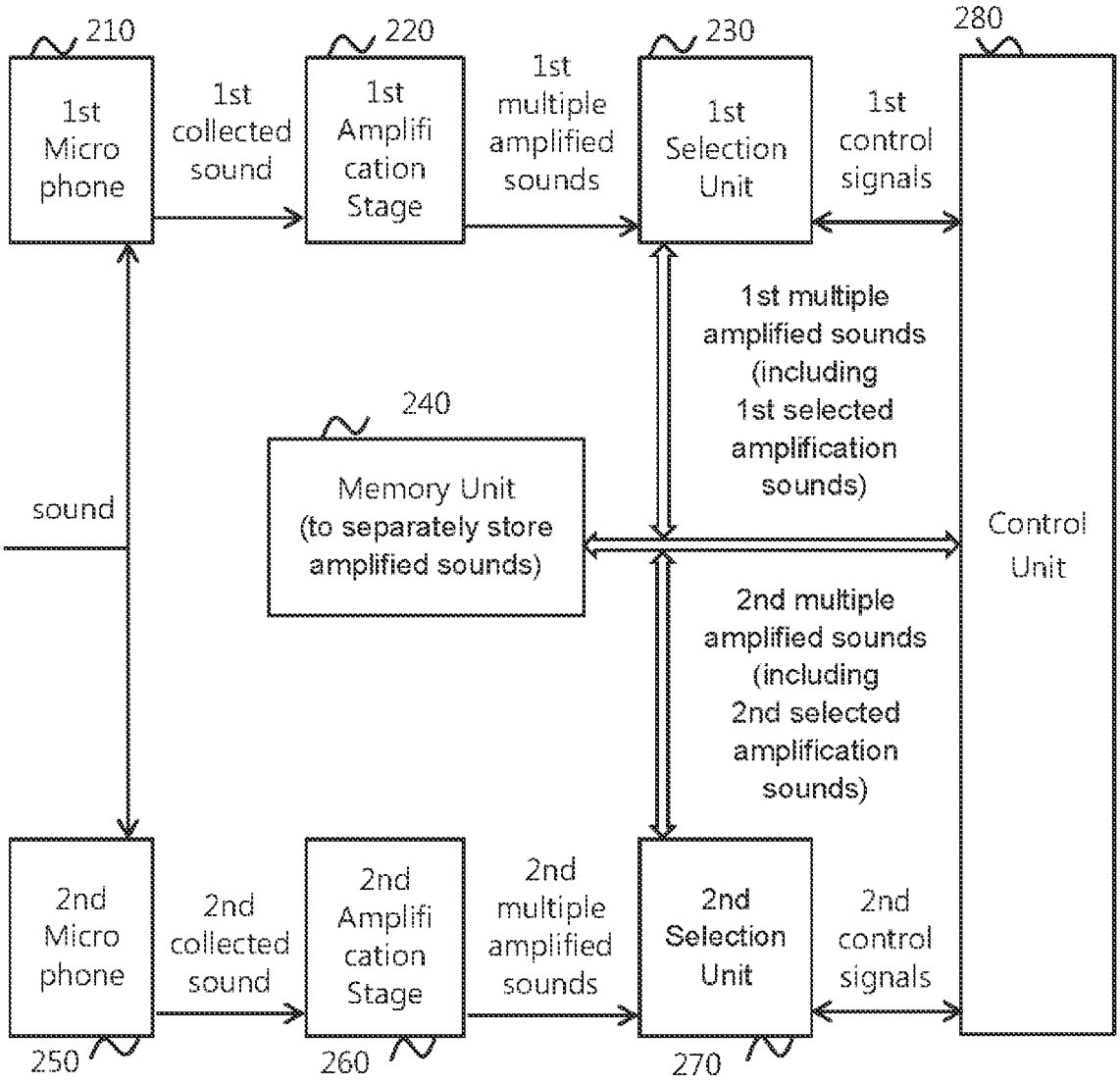
FIG. 2 is a configuration diagram illustrating an system for collection of sound by a plurality of microphones according to one embodiment of the present invention.
Figure 5:
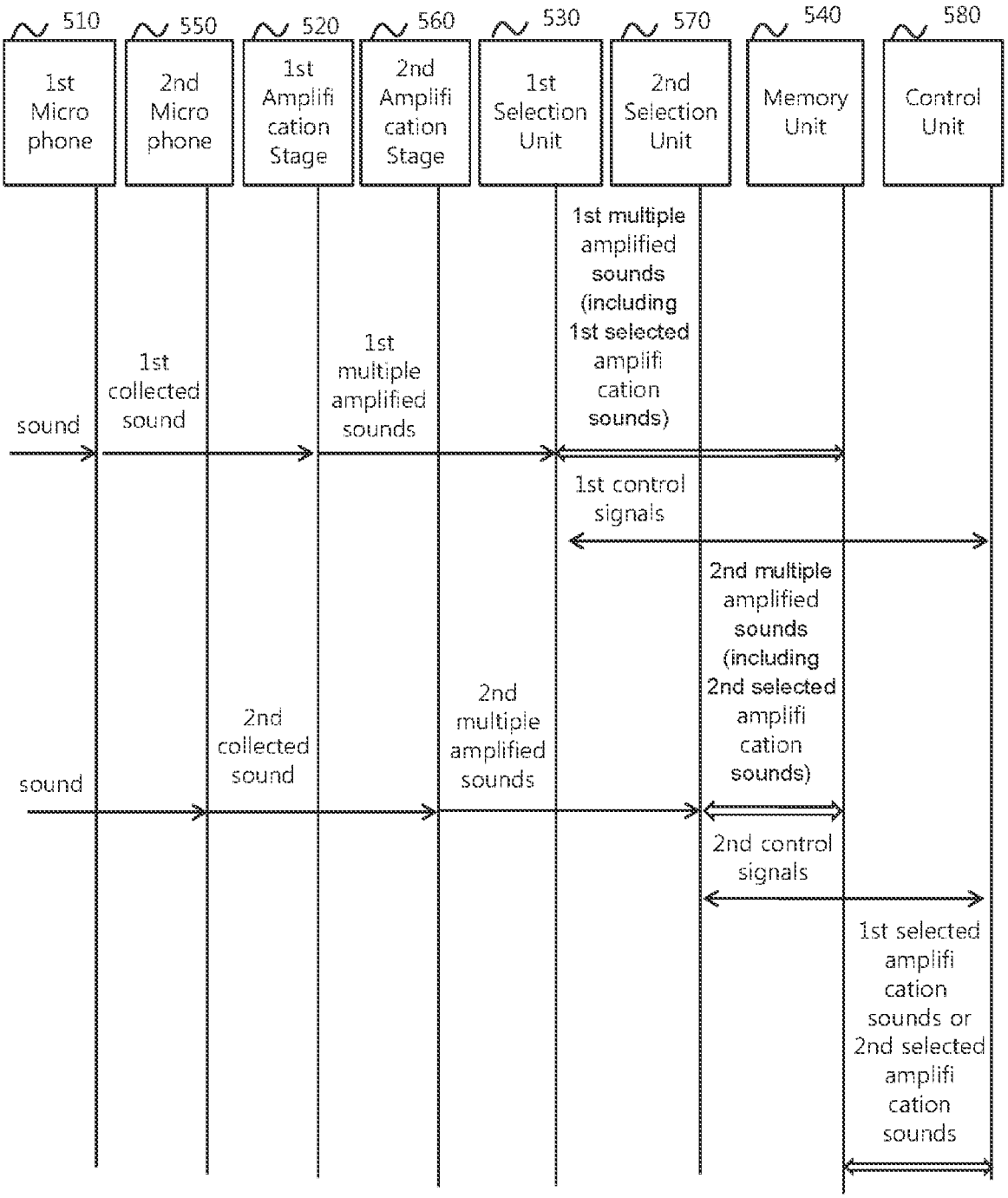
FIG. 5 is a flowchart of FIG. 2 according to the embodiment of the present invention.

FIG. 2 is a configuration diagram of a system for collection of all sounds generated over a broad area using a plurality of microphones without loss thereof, and FIG. 5 is a flowchart of FIG. 2.

Referring to FIGS. 2 and 5, a plurality of microphones 210, 250 may collect all sounds generated over a broad area and transfer the collected sounds to a plurality of amplification stages 220, 260; the amplification stages 220, 260 amplify the collected sounds at a plurality of amplification factors and transfer the multiple amplified sounds to a plurality of selection units 230, 270; the selection units 230, 270 may separately transfer the multiple amplified sounds in a memory unit 240 using the control signals, while determining an amplitude of each amplified sound, adding information of the selected amplification sounds to the control signals and transmitting the control signals to a control unit 280; and the control unit 280 may search the memory unit 240 for the selected amplification sounds corresponding to the control signals, respectively, and control the same. Herein, the concept in FIG. 2 is also applicable to three or more microphones.

Figure 3:
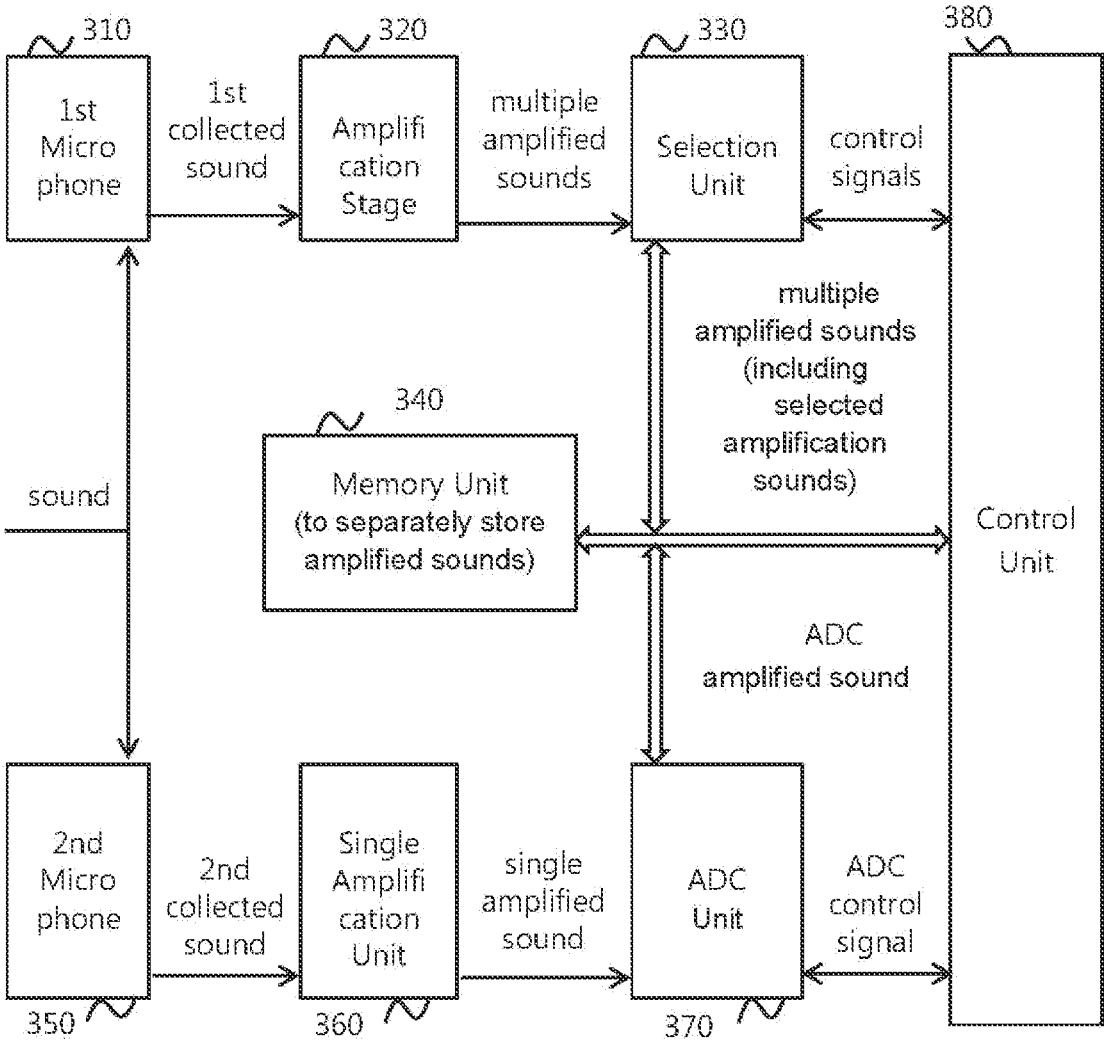
FIG. 3 is a configuration diagram illustrating a system for collection of sound by a plurality of microphones according to another embodiment of the present invention.
Figure 6:
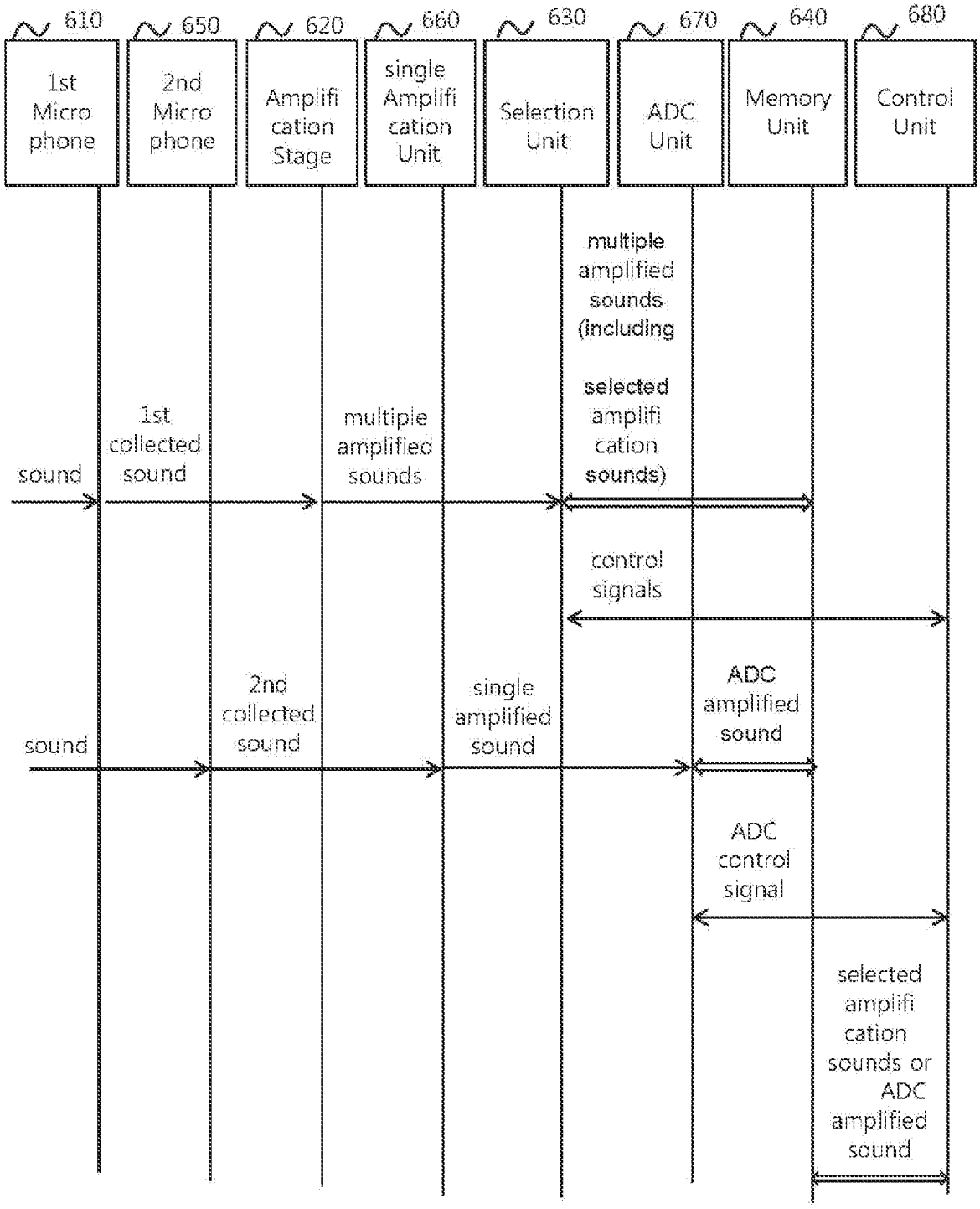
FIG. 6 is a flowchart of FIG. 3 according to the embodiment of the present invention.

FIG. 3 illustrates a sound collection system according another embodiment of the present invention wherein sound collected by some among the plurality of microphones may be collected via a route involving a plurality of amplifiers, while sounds collected by some other ones among the plurality of microphones may be collected via another route involving a single amplifier, whereby all sounds generated over a broad area may be collected without loss thereof. FIG. 6 is a flowchart of FIG. 3.

Referring to FIGS. 3 and 6, a first microphone 310 and a second microphone 350 may collect sound, and then, the first microphone 310 may transfer a first collected sound to a first amplification stage 320; the first amplification stage 320 may amplify the first collected sound at a plurality of amplification factors and transfer the multiple amplified sounds to a selection unit 330; the selection unit 330 may separately transfer the multiple amplified sounds in a memory unit 340 using control signals, while determining an amplitude of each of the multiple amplified sounds, adding information on the selected amplified sound to the control signals and transmitting the control signals to a control unit 380; and the control unit may search the memory unit for the selected amplification sounds corresponding to the control signals and control the same and, at the same time, the second microphone 350 may transfer a second collected sound to a single amplification unit 360; the single amplification unit 360 may amplify the second collected sound at one amplification factor and transfer the single amplified sound to an ADC unit 370; the ADC unit 370 may transfer an ADC amplified sound corresponding to the single amplified sound in the memory unit 340 using ADC control signal; and the control unit 380 may search the memory unit 340 for the selected amplification sounds corresponding to the control signals and the ADC amplified sound corresponding to the ADC control signal and control the same.

The single amplification unit 360 may amplify the collected sound at one amplification factor using a single amplifier, wherein non-amplification or attenuated amplification may also be included.

The ADC unit 370 may convert analog type amplified sound into digital sound and transfer the same in the memory unit. The ADC unit of the present invention is not operable to determine the amplitude.

ADC control signal may refer to a control signal by which the control unit operates the ADC unit 370 to convert analog type signal into digital sound and then store the same in the memory unit.

The same concept as in FIG. 3 is applicable even when three or more microphones are used.

Figure 7:
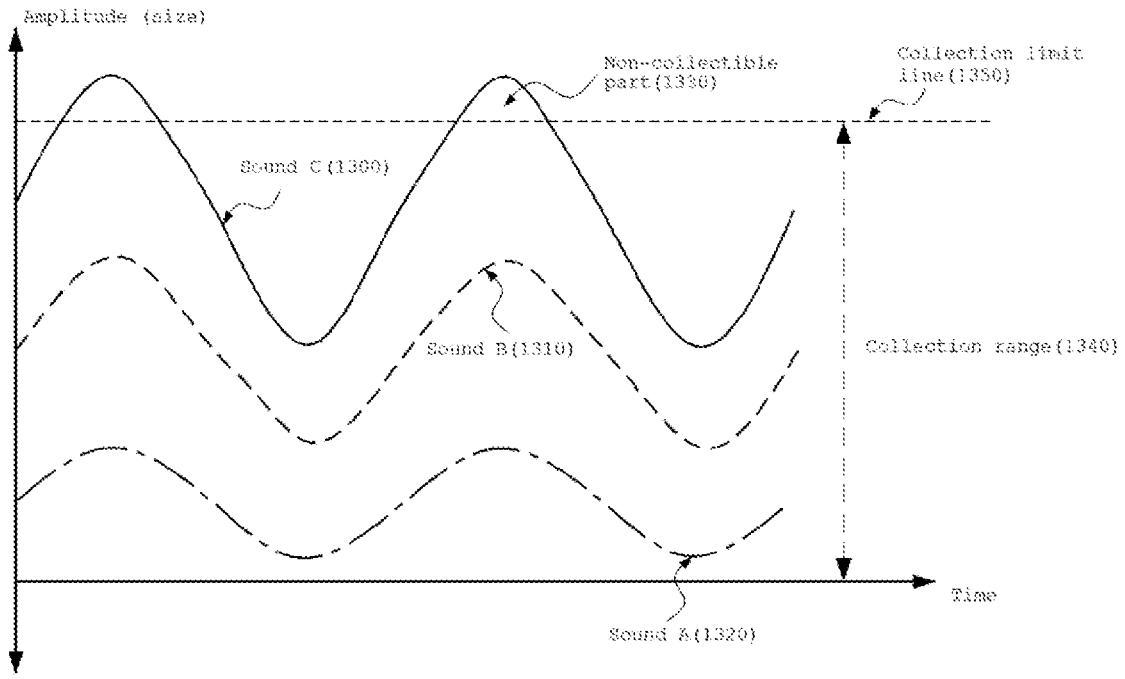
FIG. 7 illustrates waveforms of amplified sounds at a plurality of amplification factors and a collection range thereof according to the present invention.

FIG. 7 is a conceptual diagram illustrating waveforms of amplified sounds and a collection range thereof according to the present invention, wherein sound A, sound B and sound C are sounds amplified at different amplification factors from the same sound collected by the amplification stage. In particular, sound A 1320 has a waveform at non-amplification and does not have any portion out of the collection range 1340, however, involves poor discrimination of sounds. Sound B 1310 has a waveform at an appropriate amplification factor and shows discrimination of sounds, and, does not have any portion out of the collection range.

Such sounds based on sound sources of sound A, sound B and sound C have problems of: not being defined in size; having a very large range of loudness by different sound sources or a large difference in pitches of the same sound source; transiently occurring and then fading out; wherein a plurality of sounds may be mixed and, if using a single amplification factor, a big sound source-based sound may be out of the collection range thus causing loss of sound; and wherein a small sound source-based sound may not be collected. A solution to overcome the above problems while increasing the discrimination of sounds is to simultaneously amplify sound at different amplification factors, followed by collecting and controlling the amplified sounds.

Figure 8:
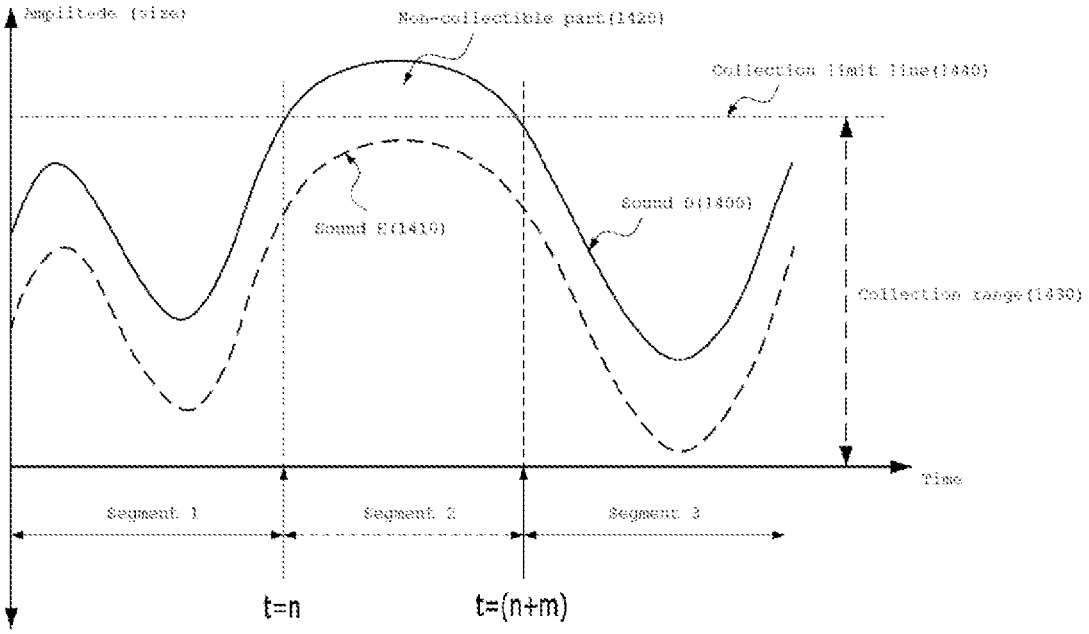
FIG. 8 illustrates the amplified sounds at a plurality of amplification factors to time segments according to the present invention.

FIG. 8 is a conceptual diagram illustrating a method of eliminating loss of the sound out of the collection range, caused by a large difference in pitches of sounds from the same sound source according to one embodiment of the present invention, wherein sounds collected from the same sound source have been amplified by the amplification stage to obtain greatly amplified sound D 1400 and moderately amplified sound E 1410, which in turn are stored in the memory unit; when the selection unit communicates with the control unit through control signals including information on the amplified sound D selected in segment 1, the control unit searches the memory unit for the amplified sound D and controls the same; further, when the selection unit communicates with the control unit through another control signal including information on the amplified sound E again selected in segment 2, the control unit searches the memory unit for the amplified sound E and controls the same; still further, when the selection unit communicates with the control unit through a further control signal including information on the amplified sound D still again selected in segment 3, the control unit searches the memory unit for the amplified sound E and controls the same, thereby collecting and controlling the sounds without loss thereof When the segment needs to be separately selected in the present invention, time information is used to connect the sounds without loss thereof. In this case, when a rule is established by the time information in connection with address in the memory unit, the control unit may control the sounds without loss thereof. In this regard, one embodiment of the present invention is shown in Table 1 below.

TABLE 1

How to store sounds based on time information in connection with address in memory unit according to one embodiment of the present invention

| Item | Data amount (byte) | Address in memory | Time | Segment |
|---|---|---|---|---|
| Sound D | 24 M | ADDR = 1 | t = 1 | Time and address corresponding to segment 1 in FIG. 8 |
| | | . . . | | |
| | | ADDR = n | t = n | |
| | | . . . | | |
| | | ADDR = (n + m) | t = (n + m) | |
| | | . . . | | |
| | | ADDR = 24 M | t = 24 M | Time and address corresponding to segment 3 in FIG. 8 |
| Sound E | 24 M | ADDR = (1 + 24 M) | t = 1 | |
| | | . . . | | |
| | | ADDR = (24 M + n) | t = n | Time and address corresponding to segment 2 in FIG. 8 |
| | | . . . | | |
| | | ADDR = (24 M + n + m) | t = (n + m) | |
| | | . . . | | |
| | | ADDR = 48 M | t = 24 M | |

Table 1 is a conceptual chart illustrating a method of storing sound by time information in connection with address in the memory unit according to one embodiment of the present invention, wherein, when a sound frequency bandwidth is limited to 20 KHz, a sampling frequency is limited to 40 KHz and a quantization level is limited to 16 Bits, data generated per second may be 80,000 bytes and a data quantity generated for 5 minutes may come to 24,000,000 bytes. Taking account for the above facts, an address of sound D 1400 may be assigned from 'ADDR=1' to 'ADDR=24 M' and an address of sound E 1410 may be assigned from 'ADDR=24 M+1' to 'ADDR=48 M'. Therefore, sound D at t=1 may be stored in 'ADDR=1' while storing sound E in 'ADDR=24 M+1', simultaneously. The address may be sequentially increased over time and the sounds may be simultaneously stored while constantly maintaining a difference in addresses (off-set) between the sound D and the sound E. Further, the above mechanism may also be applied to a system and a method for collection of sound using a plurality of microphones.

Referring to FIG. 8 and Table 1,t=n is a point at which the amplified sound D starts to escape the collection range, t=(n+m) is a last point at which the amplified sound D is out of the collection range. When the selection unit transfers control signals including information on the amplified sound E again selected at t=n and time information, that is, t=n to the control unit, the control unit may search the memory unit for sound corresponding to 'ADDR=(24 M+n)' of the amplified sound E from t=n and start to control the sound. Further, when the selection unit transfers another control signal including information on the amplified sound D again selected at t=n+m+1 and time information, that is, t=n+m+1 to the control unit, the control unit may search the memory unit for sound corresponding to 'ADDR=(n+m+1)' of the amplified sound D from t=n+m+1 and control the same.

As shown in FIG. 8, if an amplitude of the amplified sound selected by the selection unit is out of the collection range at any point of time, another amplified sound may be immediately selected, followed by searching the memory unit for the amplified sound again selected as described above and controlling the same from the starting point rather than the point of time at which the amplification is out of the collection range.

According to the above method, the amplified sound D may be controlled in segment 1, the amplified sound E may be controlled in segment 2 and the amplified sound D may be again controlled in segment 3, thereby collecting and controlling sounds without loss thereof.

INDUSTRIAL APPLICABILITY

As described above, the present invention relates to a system and a method for collection of sound generated over a broad area, in particular, unspecified and various sounds generated in fields of crime prevention, precaution, etc. using a microphone without loss thereof, and provides a means for the sound collection system and method using a single microphone and/or a means for the sound collection system and method using a plurality of microphone.

The invention claimed is:

1. A sound collection system to collect multiple amplified sounds including selected amplification sounds into a memory unit, the system comprising:

a microphone that makes a collected sound from a surrounding sound and transfers the collected sound to an amplification stage;

the amplification stage that receives the collected sound from the microphone, amplifies the collected sound at a plurality of amplification factors to generate the multiple amplified sounds, and transfers the multiple amplified sounds to a selection unit;

the selection unit that receives the multiple amplified sounds from the amplification stage, transfers the multiple amplified sounds to the memory unit, selects the selected amplification sounds from among the multiple amplified sounds using amplitudes, and transfers control signals to a control unit, wherein the control signals include information on the selected amplification sounds;

the memory unit that receives the multiple amplified sounds including the selected amplification sounds from the selection unit, stores the multiple amplified sounds therein, and transfers the selected amplification sounds to the control unit in response to requests from the control unit; and the control unit that receives the control signals from the selection unit and collects from the memory unit the selected amplification sounds corresponding to the control signals.

2. A sound collection method to collect multiple amplified sounds including selected amplification sounds into a memory unit, the method comprising:

(a) making a collected sound by a microphone from a surrounding sound and transferring the collected sound to an amplification stage;

(b) amplifying by the amplification state the collected sound at a plurality of amplification factors to generate the multiple amplified sounds, and transferring the multiple amplified sounds to a selection unit;

(c) transferring by the selection unit the multiple amplified sounds to the memory unit, selecting by the selection unit the selected amplification sounds from among the multiple amplified sounds using amplitudes, and transferring control signals to a control unit, wherein the control signals include information on the selected amplification sounds;

(d) storing by the memory unit the multiple amplified sounds including the selected amplification sounds therein; and (e) collecting by the control unit from the memory unit the selected amplification sounds corresponding to the control signals.

3. A sound collection system to collect first multiple amplified sounds including first selected amplification sounds and second multiple amplified sounds including second selected amplification sounds into a memory unit, the system comprising:

a first microphone that makes a first collected sound from a surrounding sound and transfers the first collected sound to a first amplification stage;

a second microphone that makes a second collected sound from the surrounding sound and transfers the second collected sound to a second amplification stage;

the first amplification stage that receives the first collected sound from the first microphone, amplifies the first collected sound at a first plurality of amplification factors to generate the first multiple amplified sounds, and transfers the first multiple amplified sounds to a first selection unit;

the second amplification stage that receives the second collected sound from the second microphone, amplifies the second collected sound at a second plurality of amplification factors to generate the second multiple amplified sounds, and transfers the second multiple amplified sounds to a second selection unit;

the first selection unit that receives the first multiple amplified sounds from the first amplification stage, transfers the first multiple amplified sounds to the memory unit, selects the first selected amplification sounds from among the first multiple amplified sounds using first amplitudes, and transfers first control signals to a control unit, wherein the first control signals include information on the first selected amplification sounds;

the second selection unit that receives the second multiple amplified sounds from the second amplification stage, transfers the second multiple amplified sounds to the memory unit, selects the second selected amplification sounds from among the second multiple amplified sounds using second amplitudes, and transfers second control signals to the control unit, wherein the second control signals include information on the second selected amplification sounds;

the memory unit that receives the first multiple amplified sounds including the first selected amplification sounds from the first selection unit, receives the second multiple amplified sounds including the second selected amplification sounds from the second selection unit, stores the first multiple amplified sounds and the second multiple amplified sounds therein, and transfers the first selected amplification sounds or the second selected amplification sounds to the control unit in response to requests from the control unit; and the control unit that receives the first control signals from the first selection unit and the second control signals from the second selection unit, and collects from the memory unit the first selected amplification sounds corresponding to the first control signals or the second selected amplification sounds corresponding to the second control signals.

4. A sound collection method to collect first multiple amplified sounds including first selected amplification sounds and second multiple amplified sounds including second selected amplification sounds into a memory unit, the method comprising:

(a) making by a first microphone a first collected sound from a surrounding sound and transferring the first collected sound to a first amplification stage; and (b) making by a second microphone a second collected sound from the surrounding sound and transferring the second collected sound to a second amplification stage;

(c) amplifying by the first amplification stage the first collected sound at a plurality of amplification factors to generate the first multiple amplified sounds and transferring the first multiple amplified sounds to a first selection unit;

(d) amplifying by the second amplification stage the second collected sound at the plurality of amplification factors to make the second multiple amplified sounds and transferring the second multiple amplified sounds to a second selection unit;

(e) transferring by the first selection unit the first multiple amplified sounds to the memory unit, selecting the first selected amplification sounds from among the first multiple amplified sounds using first amplitudes, and transferring first control signals to a control unit, wherein the first control signals include information on the first selected amplification sounds;

(f) transferring by the second selection unit the second multiple amplified sounds to the memory unit, selecting the second selected amplification sounds from among the second multiple amplified sounds using second amplitudes, and transferring second control signals to the control unit, wherein the second control signals include information on the second selected amplification sounds;

(g) storing by the memory unit the first multiple amplified sound including the first selected amplification sounds and the second multiple amplified sound including the second selected amplification sounds therein; and (h) collecting by the control unit from the memory unit the first selected amplification sounds corresponding to the first control signals or the second selected amplification sounds corresponding to the second control signals.

5. A sound collection system to collect an ADC (analog to digital conversion) amplified sound and multiple amplified sounds including selected amplification sounds into a memory, the system comprising:

a first microphone that makes a first collected sound from a surrounding sound and transfers the first collected sound to an amplification stage;

a second microphone that makes a second collected sound from the surrounding sound and transfers the second collected sound to a single amplification unit;

the amplification stage that receives the first collected sound from the first microphone, amplifies the first collected sound at a plurality of amplification factors to generate the multiple amplified sounds, and transfers the multiple amplified sounds to a selection unit;

the single amplification unit that receives the second collected sound from the second microphone, amplifies the second collected sound at a single amplification factor to generate the single amplified sound, and transfers the single amplified sound to an ADC unit;

the selection unit that receives the multiple amplified sounds from the amplification stage, transfers the multiple amplified sounds to the memory unit, selects the selected amplification sounds from among the multiple amplified sounds using amplitudes, and transfers control signals to a control unit, wherein the control signals include information on the selected amplification sounds;

the ADC unit that receives the single amplified sound from the single amplification unit, transfers the ADC amplified sound corresponding to the single amplified sound to the memory unit, and transfers an ADC control signal, wherein the ADC control signal includes information on the ADC amplified sound;

the memory unit that receives the multiple amplified sounds including the selected amplification sounds from the selection unit, receives the ADC amplified sound from the ADC unit, stores the multiple amplified sounds and the ADC amplified sound therein, and transfers the selected amplification sounds or the ADC amplified sound to the control unit in response to requests of the control unit; and the control unit that receives the control signals from the selection unit and the ADC control signal from the ADC unit, and collects from the memory unit the selected amplification sounds corresponding to the control signals or the ADC amplified sound corresponding to the ADC control signal.

6. A sound collection method to collect an ADC (analog to digital conversion) amplified sound and multiple amplified sounds including selected amplification sounds into a memory, the method comprising:

(a) making by a first microphone a first collected sound from a surrounding sound and transferring the first collected sound to an amplification stage;

(b) making by a second microphone a second collected sound from the surrounding sound and transferring the second collected sound to a single amplification unit;

(c) amplifying by the amplification stage the first collected sound at a plurality of amplification factors to generate the multiple amplified sounds and transferring the multiple amplified sounds to a selection unit;

(d) amplifying by the single amplification unit the second collected sound at a single amplification factor to generate a single amplified sound and transferring the single amplified sound to an ADC unit;

(e) transferring by the selection unit the multiple amplified sounds to the memory unit, selecting the selected amplification sounds using amplitudes, and transferring control signals to a control unit, wherein the control signals include information on the selected amplification sounds;

(f) transferring by the ADC unit the ADC amplified sound corresponding to the single amplified sound to the memory unit and transferring an ADC control signal to the control unit, wherein the ADC control signal includes information on the ADC amplified sound;

(g) storing by the memory unit the multiple amplified sound including the selected amplification sounds and the ADC amplified sound therein; and (h) collecting by the control unit from the memory unit the selected amplification sounds corresponding to the control signals or the ADC amplified sound corresponding to the ADC control signal.

* * * * *